United States Patent [19]

Reader et al.

[11] 3,956,666

[45] May 11, 1976

[54] ELECTRON-BOMBARDMENT ION SOURCES

[75] Inventors: Paul D. Reader; Harold R. Kaufman, both of Fort Collins, Colo.

[73] Assignee: Ion Tech, Inc., Fort Collins, Colo.

[22] Filed: Jan. 27, 1975

[21] Appl. No.: 544,240

[52] U.S. Cl. ..... 315/111.8; 60/202; 313/362

[51] Int. Cl.[2] ..... F03H 5/00; H05H 1/00

[58] Field of Search ..... 313/359–363; 315/111, 111.8; 60/202

[56] References Cited

UNITED STATES PATENTS

| | | | |
|---|---|---|---|
| 3,156,090 | 11/1964 | Kaufman | 313/362 X |
| 3,697,793 | 10/1972 | King | 313/361 |

*Primary Examiner*—Palmer C. Demeo
*Attorney, Agent, or Firm*—Hugh H. Drake

[57] ABSTRACT

An electron-bombardment ion source includes a chamber into which a propellant is introduced. The propellant is ionized by means of electrons drawn toward an anode from a cathode. At one end of the chamber is an apertured screen followed by an aligned apertured grid. The grid is maintained at a potential that accelerates the ions out of the chamber through the screen and the grid and past a space-charge-neutralizing cathode. A resistor is connected between the grid and the neutralizing cathode in order to maintain the latter at a positive potential relative to the potential on the grid. A system ground preferably is connected to the junction between the resistor and the neutralizing cathode but, alternatively, may be connected between the grid and the resistor.

14 Claims, 3 Drawing Figures

ELECTRON-BOMBARDMENT ION SOURCES

The present invention pertains generally to electron-bombardment ion sources. More particularly, it relates to a power supply arrangement for such sources.

Electron-bombardment ion sources were originally developed as a means of propulsion in outer space. As compared with conventional chemical rockets, the high exhaust velocities available from such ion sources permitted a reduction in propellant mass needed to meet the same propulsion requirement. An earlier version of such an ion source, as developed specifically for space propulsion, is disclosed in U.S. Pat. No. 3,156,090. Various modifications and improvements on such an ion source are disclosed in U.S. Pat. Nos. 3,238,715, 3,262,262, and 3,552,125. More recent modifications and still further improvements are disclosed in copending applications Ser. No. 523,483, filed Nov. 13, 1974, and Ser. No. 524,655, filed Nov. 18, 1974, both having the same inventors, title and assignee of the present application.

Electron-bombardment ion sources have now also found use in the field of sputter machining. In that field, the ion beam produced by the source is directed against a target, so as to result in the removal of material from the target. This effect is termed sputter erosion. By protecting chosen portions of the target from the oncoming ions, material may be effectively removed from the other portions of the target. That is, these other portions of the target are thereby selectively machined.

Alternatively, essentially the same apparatus can be used for what is called sputter deposition. In this case, a surface to be coated is disposed so as to face the target in order to receive material eroded from the target. Selected portions of the surface under treatment may be masked so that the sputtered material is deposited in accordance with a chosen pattern. Moreover, several different types of material may be ionically bombarded simultaneously so as to result in a controlled deposition of alloys of the different materials. In some cases, sputter deposition represents the only way in which the formation and deposit of such alloys may be achieved.

Still another use of the described ion sources is in the implantation or doping of ions into a semi-conductor material. Basically, this usage differs from sputter machining only in that higher ion energies are required in order to obtain a useful distance of penetration into the semiconductor material.

Whatever the specific manner of utilization, such ion sources are especially attractive for sophisticated tasks like those of forming integrated circuit patterns. For example, conductive lines may be deposited on a substrate in thicknesses measured in Angstroms and with widths measuring but tenths or hundredths of a micron. Defects in linearity may be held to less than a few hundredths of a micron.

Electron-bombardment ion sources of the kind under discussion include a chamber into which an ionizable propellant, such as argon, is introduced. Within the chamber is an anode that attracts high-velocity electrons from a cathode. Impingement of the electrons upon the propellant atoms results in ionization of the propellant. At one end of the chamber is an apertured screen followed by an aptertured grid. A potential impressed upon the grid accelerates the ions out of the chamber through the apertures in both the screen and the grid, while the apertures in the screen are alined with those in the grid so as to shield the latter from direct ionic bombardment. At least usually, another electron-emissive cathode is disposed beyond the grid for the purpose of effecting neutralization of the electric space-charge otherwise exhibited by the accelerated ion beam. Preferably, the interior of the chamber is subjected to a magnetic field which causes the electrons emitted from the cathode to gyrate in their travel toward the anode. This greatly increases the chance of an ionizing collision between any given electron and one of the propellant atoms, thus resulting in substantially increased efficiency of ionization.

Heretofore, ion sources of the kind under discussion have included a plurality of individually distinct power supplies for the purpose of providing the various potential differences and currents required. In addition to power supplies for heating the cathodes to electron-emissive temperatures, a first power supply has been included for establishing electron flow within the ionization chamber, a second power supply has been utilized to provide the potential difference necessary to accelerate the ions out of the chamber through the apertured grid and a third power supply has been incorporated to provide a potential barrier that prevents neutralizing electrons from being drawn back through the grid and screen. While this approach has led to high efficiency in terms of minimizing power losses and has been consistent with an objective of minimizing weight, particularly applicable to space propulsion, it also is somewhat cumbersome and costly.

It is, accordingly, a general object of the present invention to provide a new and improved power supply arrangement for an electron-bombardment ion source that results in increased simplicity and lower cost.

Another object of the present invention is to provide a new and improved ion source power supply arrangement that enables easily adjusted selection of the relative amounts of acceleration and deceleration to which the ion beam is subjected in operation of the system.

An electron-bombardment ion source constructed in accordance with the present invention includes means defining a chamber for containing an ionizable propellant, together with means for introducing that propellant within the chamber. An anode disposed within the chamber cooperates with an electron-emissive cathode also disposed therein. A potential is impressed between the cathode and the anode in order to effect electron emission at a sufficient velocity to ionize the propellant. Disposed in the vicinity of one end of the chamber is an apertured grid. A potential is impressed between that grid and both the cathode and the anode in order to accelerate the ions out of the chamber through the grid. Neutralization means, located beyond the grid from the chamber, serves to neutralize the electric space charge in the ions that flow beyond the grid. Finally, a resistor is connected between the grid and the neutralizing means for the purpose of maintaining the neutralizing means at a positive potential relative to the potential on the grid.

The features of the present invention which are believed to be novel are set forth with particularity in the appended claims. The invention, together with further objects and advantages thereof, may best be understood by reference to the following description taken in connection with the accompanying drawings, in the several figures of which like reference numerals and letters identify like elements, and in which:

Figure 1:
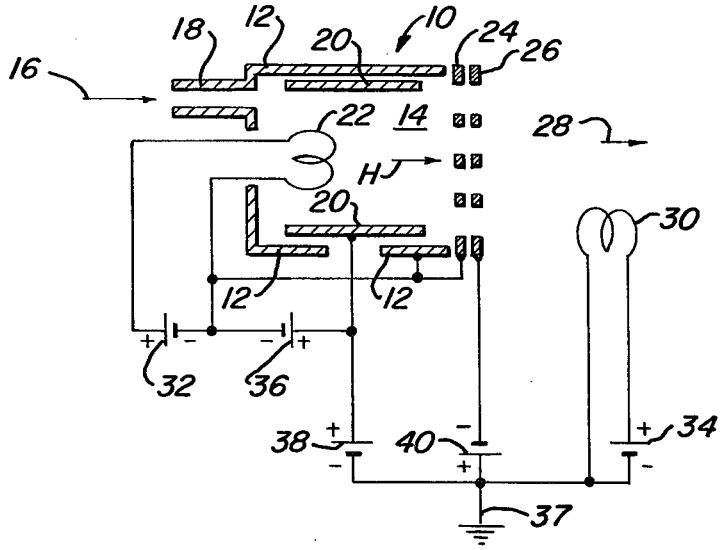
Fig 1 (PRIOR ART)
FIG. 1 is a schematic diagram of a known electron-bombardment ion source, including its associated power supply arrangement.
Figure 2:
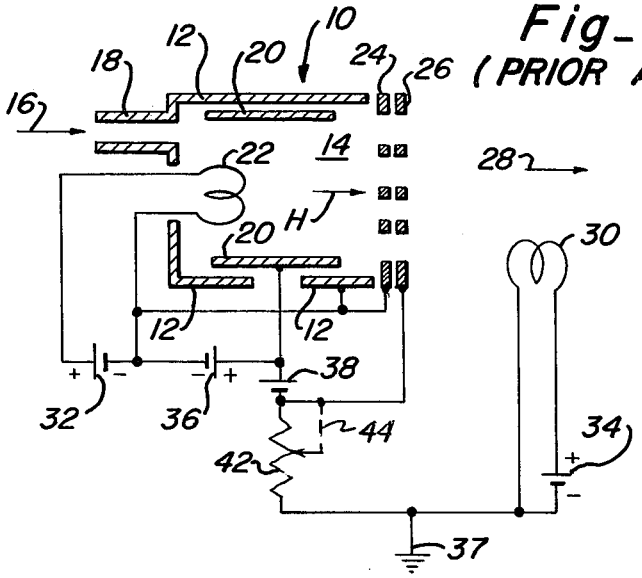
FIG. 2 is a schematic diagram of an electron-bombardment ion source and its included power supply arrangement in accordance with a preferred embodiment of the present invention.
Figure 3:
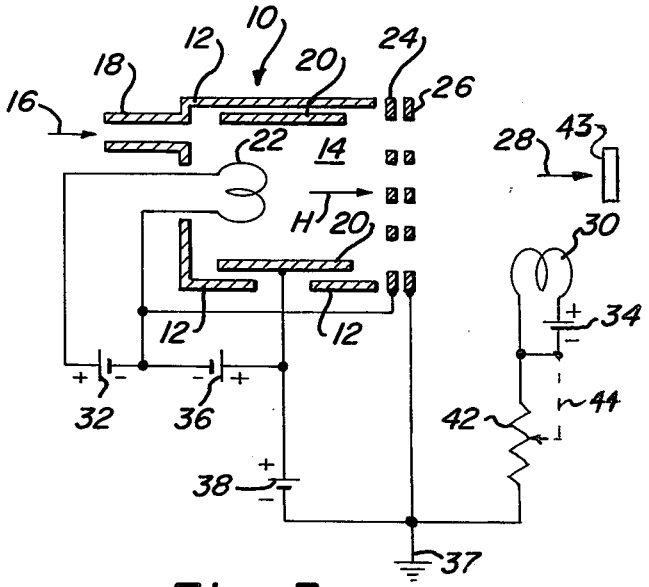
FIG. 3 is a schematic diagram of an electron-bombardment ion source together with its associated power supply arrangement constructed in accordance with an alternative embodiment of the present invention.

In order to gain a better understanding of the subject matter, an explanation will first be given with respect to the nature and operation of a typical known electron-bombardment ion source as illustrated in FIG. 1. It will initially be observed that FIG. 1, like FIGS. 2 and 3, is set forth in schematic form. The actual physical structure of the apparatus may, of course, vary, but a suitable and workable implementation is that disclosed in the aforesaid U.S. Letters Pat. No. 3,156,090, which patent, therefore, is expressly incorporated herein by reference. Thus, a housing 10 is in the form of a cylindrical metallic shell 12 that circumscribes and defines a chamber 14 in which an ionizable propellant, such as argon, is to be contained. As indicatd by the arrow 16, the propellant is introduced into one end of shell 12 through a manifold 18. Disposed symmetrically within shell 12 is a cylindrical anode 20. Centrally positioned within anode 20 is a cathode 22.

In the vicinity of the end of shell 12, opposite that which, in this case, manifold 18 is located, there is an apertured screen 24. Spaced beyond screen 24 is an apertured grid 26. The apertures in screen 24 are aligned with the apertures in grid 26 so that the solid portions of grid 26 are shielded from bombardment of ions that are withdrawn from chamber 14 through screen 24 and grid 26 so as to proceed along a beam path indicated by the arrow 28. As mentioned in the introduction, a magnetic field, indicated by arrow H, preferably is established within chamber 14 as by inclusion of a suitable electromagnet or permanent magnet structure surrounding shell 12. The direction of the magnetic lines of force is such as to cause electrons emitted from cathode 22 to gyrate or convolute in their passage toward anode 20. Situated beyond grid 26 from chamber 14 is a neutralization cathode 30.

As herein embodied, cathodes 22 and 30 are each formed of tungsten wire the opposite ends of which are individually connected across respective energizing sources 32 and 34. Sources 32 and 34 may deliver either direct or alternating current. Other types of cathodes, such as a hollow cathode which, during normal operation, requires no heating current, may be substituted. For creating and sustaining electron emission from cathode 22, a direct-current source 36 is connected with its negative terminal to cathode 22 and its positive terminal to anode 20. Connected with its positive terminal to anode 20 and its negative terminal returned to system ground 37, as indicated, is a main power source 38 of direct current. Another direct-current source 40 has its negative terminal connected to accelerator grid 26 and its positive terminal returned to system ground. Finally, one side of neutralizing cathode 30 also is returned to ground. Completing the energization arrangements, both screen 24 and the wall of shell 12 are connected to one side of cathodoe 22. Alternative arrangements are known in which screen 24 and the wall of shell 12 are permitted to float in potential.

In operation, the gaseous propellant introduced through manifold 18 is ionized by high-velocity electrons flowing from cathode 22 toward anode 20. The pressure within chamber 14 is sufficiently low, of the order of $10^{-4}$ Torr, that the emitted electrons tend to proceed to anode 20 with a rather low probability of creating ionization of the propellant. However, the magnetic field causes the electrons to gyrate so as very substantially to increase the probability of collisions between the electrons and the atoms in the propellant. Ions in the plasma which is thus produced are attracted by accelerator grid 26 so as to be drawn along path 28. Screen 24 serves to focus the withdrawn ions so that they escape through grid 26 without impinging upon its solid portions. The resulting ion beam traveling along path 28 is then neutralized in electric space-charge by means of electrons emitted from neutralizing cathode 30. Power source 36 serves to maintain the discharge current between cathode 22 and anode 20. The energy in the ions which constitute the ion beam is maintained by power source 38. Power source 40 supplies the negative potential on grid 26 necessary to prevent electrons emitted from neutralizing cathode 30 from flowing back through grid 26 and screen 24, as well as providing additional potential to that of power source 38 for accelerating the ions out of chamber 14.

While the various potentials involved will vary depending upon the particular propellant utilized, a typical value for the potential of source 36 is between 10 and 50 volts. The potential difference exhibited by power source 38 has an exemplary value of 500 volts in a sputtering application, 1000 volts in usage of the ion source for electric space propulsion and 50,000 volts or more for ion implantation. The absolute potential magnitude of accelerating source 40 is generally 0.1 to 1.0 times that of main power source 38. The current through accelerating source 40 is usually only a small fraction of the ion beam current, often of the order of 0.01 or less. Consequently, the ion beam current is substantially equal to the current delivered from main power source 38. For tungsten filaments, cathode heating potentials are typically of the order of 5 to 15 volts. The discharge power involved, the potential from source 36 times the current delivered thereby, generally ranges from about 200 to 1000 watts per ampere of ions formed in the ultimate ion beam.

For space propulsion, neutralizer 30 is always required. In other applications, such as in sputtering, it may be possible to omit neutralizer 30. For example, with the ion-impinged target connected to the system ground, neutralizer 30 may not be required in cases in which a comparatively low ion beam current is involved.

To initiate the production of ions within chamber 14, the usual approach has been to impress a high potential difference between cathode 22 and anode 20. That starting potential has been either a direct current or a pulse. Alternatively, or in combination, it has also been known to decrease the applied magnetic field strength. In any event, the effective initial high potential difference has usually been between 50 and 100 percent higher than the desired steady-state operating value. Another consideration which may be involved is that of obtaining uniformity and density across the width of the produced ion beam. Improved arrangements both for initiating the production of ions and in obtaining greater uniformity in the resulting ion beam are disclosed and claimed in the aforementioned copending applications. Since it is preferred that those improved arrangements be included not only in connection with the ion source of FIG. 1 but also in connection with the ion sources and arrangements of the improved embodiments of FIGS. 2 and 3 to be discussed further hereinafter, those copending applications are expressly incorporated herein by reference.

As depicted in FIG. 1, each of the different power sources is represented by the symbol conventionally employed to represent a battery. At least ordinarily, this refers to a device in which stored chemical energy may be converted to and delivered as electrical energy. Indeed, each one of the power sources utilized in FIG. 1 may be just such a battery of the electro-chemical type. Alternatively, other forms of power sources may be, and in some cases have been, employed. Examples of such alternative sources are those which are dynamo-electric, thermo-electric, magneto-electric (e.g., static transformer) and nuclear-electric (either directly or in combination with any one or more of thermal, dynamic and electric apparatus). In any event, the term "power source" refers to a device or apparatus in which there is some kind of active conversion of energy from one basic form to another and as distinguished from a device in which energy of the same form is merely adjusted in level as exemplified by the adjustment of electrical voltage in a resistor. Whenever any of sources 36, 38 and 40 are of a form which basically supply alternating current, some form of current rectifying device or apparatus must be included in order to achieve the actual delivery of direct current.

A feature of the systems of FIGS. 2 and 3 is that power source 40, of FIG. 1, is eliminated. To that end, a resistor 42 is connected between grid 26 and neutralizing cathode 30. Resistor 42 in that connection serves to maintain neutralizer cathode at a potential which is positive relative to the potential on grid 26. Specifically in FIG. 2, the junction between one end of resistor 42 and neutralizing cathode 30 is connected to system ground 37. In FIG. 3, on the other hand, the junction between the other end of resistor 42 and grid 26 is connected to system ground 37. In any case, it will be observed that a first direct-current-conductive path couples grid 26 to ground 37, and a second direct-current-conductive path couples neutralizing cathode 30 to ground 37. Resistor 42 is included in series in one or the other of those conductive paths.

In FIG. 2, in which resistor 42 is included in series with the conductive path between grid 26 and ground 37, neutralizing cathode 30 is maintained at least substantially at the potential of ground 37. In FIG. 3, on the other hand and in which resistor 42 is included in series with the conductive path between neutralizing cathode 30 and ground 37, it is grid 26 which is maintained at least substantially at the potential of ground 37. In either case, the ions produced within chamber 14 are subjected to an accelerating potential in their travel through accelerating grid 26. From grid 26 past neutralizing cathode 30, the ions in the beam are subjecting to a decelerating potential gradient. Preferably, only a relative small decelerating potential gradient is employed, as compared with the much larger accelerating potential gradient existing prior to grid 26, in order to obtain better focusing of the ion beam. Moreover, the embodiment of FIG. 2 is preferred to that of FIG. 3, because the ultimate potential existing on the ion beam itself is thereby maintained at a value which is closer to that existing at system ground 37.

In the case of utilization of the systems of either FIG. 2 or FIG. 3, neutralizing cathode 30 preferably is maintained at a potential which is intermediate the potential on grid 26 and the general potential level exhibited within chamber 14. Screen 24 is maintained at a potential which is at least substantially at that potential generally exhibited within chamber 14.

In the system of FIG. 1, the potential difference across power source 38 is in actuality a net accelerating potential difference that defines the energy of the ions in the ion beam. In the system of FIG. 2, on the other hand, the potential difference across source 38 is the total accelerating potential difference. The change in potential difference across source 38, as between the systems of FIGS. 1 and 2, is the potential difference which appears across resistor 42 by reason of the fact that the current drawn by grid 26 is only a small fraction of the current through power source 38. There is no difficulty in calculating quite accurately the value required for resistor 42 on the basis of the desired potential and current levels required from power source 38 for the end operating conditions being sought. Also because the current drawn by grid 26 is comparatively small, the power which is dissipated in resistor 42 is approximately equal to the additional power that is required by the system of FIG. 2 as compared with that of FIG. 1.

In FIG. 3, it is the current required by neutralizer cathode 30 which is utilized to establish the decelerating potential difference that is to exist between grid 26 and cathode 30. When a target 43 for the ion beam is a nonconductor, the current drawn by cathode 30 is substantially equal to the current through power source 38. When target 43 for the ion beam is a conductor, on the other hand, and in the conventional manner is maintained at the potential of ground 37, the current drawn by neutralizer cathode 30 is contemplated to be much smaller than the current flowing through power source 38. Thus, the value of resistor 42 to be selected in this case will depend upon the particular nature and manner of use of the target on which the ion beam is to impinge. Consequently, the additional power required by the system of FIG. 3 also will depend upon the kind of target and the manner of its association.

In retrospect, it will be observed that implimentation of the invention is of paramount simplicity. As compared with the prior use of a separate and additional power supply, cost is significantly reduced. In addition, mere adjustment of the value selected for resistor 42 is all that is required to obtain whatever decelerating-potential profile is best suited for a given set of operating conditions and desired application. To that end, resistor 42 desirably is adjustable as indicated by tap 44 shown in dashed outline. By changing the position of tap 44, the net resistance actually presented by resistor 42 in its conductive path may be varied.

While particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. An electron-bombardment ion source comprising:

means defining a chamber for containing an ionizable propellant;

means for introducing said propellant within said chamber;

an anode disposed within said chamber;

an electron-emissive cathode disposed within said chamber;

means for impressing a potential between said cathode and said anode to effect electron emission at a sufficient velocity to ionize said propellant;

an apertured grid disposed in the vicinity of one end of said chamber;

power source means for impressing a potential between said grid and both said cathode and said anode for accelerating ions out of said chamber through said grid;

neutralization means located beyond said grid from said chamber, for neutralizing the electric space charge in ions flowing beyond said grid;

a system ground for said ion source;

first direct-current conductive means for coupling said grid to said system ground;

second direct-current conductive means for coupling said neutralizing means to said system ground;

and a resistor included in series with one of said first and second conductive means for maintaining said neutralizing means at a positive potential relative to the potential on said grid.

2. An ion source as defined in claim 1 which further includes an apertured screen spaced toward said chamber from said grid, in which the apertures in said screen are alined relative to the apertures in said grid so that said screen shields said grid from ionic bombardment, and which also includes means for maintaining said screen at least substantially at a potential exhibited within said chamber.

3. An ion source as defined in claim 1 in which said resistor is included in series with said first conductive means.

4. An ion source as defined in claim 3 in which said neutralizing means is maintained at least substantially at the potential of said system ground.

5. An ion source as defined in claim 1 in which said resistor is included in series with said second conductive means.

6. An ion source as defined in claim 5 in which said grid is maintained at least substantially at the potential of said system ground.

7. An ion source as defined in claim 5 in which a non-conductive target for said ions is spaced beyond said neutralizing means from said grid, and in which the value of said resistor is selected so that the current flow through said resistor is at least substantially equal to the current flow through said power source means.

8. An ion source as defined in claim 5 in which a conductive target for said ions is spaced beyond said neutralizing means from said grid, and in which said resistor is selected so that the current flow through said resistor is substantially less than the current flow through said power source means.

9. An ion source as defined in claim 1 in which said neutralizing means is maintained at a potential intermediate the potential on said grid and a potential exhibited within said chamber.

10. An ion source as defined in claim 1 in which the value of resistance presented by said resistor is adjustable.

11. An electron-bombardment ion source comprising:

means defining a chamber for containing an ionizable propellant;

means for introducing said propellant within said chamber;

an anode disposed within said chamber;

an electron-emissive cathode disposed within said chamber;

means for impressing a potential between said cathode and said anode to effect electron emission at a sufficient velocity to ionize said propellant;

an apertured grid disposed in the vicinity of one end of said chamber;

power source means for impressing a potential between said grid and both said cathode and said anode for accelerating ions out of said chamber through said grid;

neutralization means, located beyond said grid from said chamber, for neutralizing the electric space charge in ions flowing beyond said grid;

and a resistor connected between said grid and said neutralizing means for maintaining said neutralizing means at a positive potential relative to the potential on said grid.

12. An ion source as defined in claim 11 in which the junction between one end of said resistor and said neutralizing means is connected to a system ground for said ion source.

13. An ion source as defined in claim 11 in which the junction between one end of said resistor and said grid is connected to a system ground for said ion source.

14. An ion source as defined in claim 11 in which said resistor is adjustable in value.

* * * * *